US005857714A

United States Patent [19]

Gustafson

[11] Patent Number: 5,857,714

[45] Date of Patent: Jan. 12, 1999

[54] SERVICE CABLE AND CABLE HARNESS FOR SUBMERSIBLE SENSORS AND PUMPS

[75] Inventor: Gregg S. Gustafson, Kirkland, Wash.

[73] Assignee: Instrumentation Northwest, Inc., Redmond, Wash.

[21] Appl. No.: 598,965

[22] Filed: Feb. 9, 1996

[51] Int. Cl.[6] ..... F16L 13/14

[52] U.S. Cl. ..... 285/95; 285/149.1; 285/286.1; 166/65.1

[58] Field of Search ..... 285/95, 149.1, 285/152.1, 285.1, 286.1; 166/65.1, 77, 264; 73/151; 403/277, 279

[56] References Cited

U.S. PATENT DOCUMENTS

| | | | |
|---|---|---|---|
| 2,839,595 | 6/1958 | Felts | 285/149.1 |
| 2,856,451 | 10/1958 | Appleton | 285/149.1 |
| 2,856,452 | 10/1958 | Appleton et al. | 285/149.1 |
| 3,861,778 | 1/1975 | Capra | 285/149.1 |
| 5,033,297 | 7/1991 | Gustafson | 73/151 |
| 5,186,253 | 2/1993 | Gustafson et al. | 166/77 |
| 5,460,224 | 10/1995 | Schalla et al. | 166/264 |

*Primary Examiner*—Eric K. Nicholson
*Attorney, Agent, or Firm*—Richardson & Folise

[57] ABSTRACT

An improved service cable and cable harness assembly for submersible sensors and pumps which includes a service cable, a well head connector and an end cap attachable to the sensor. The service cable secured at its lower end to the end cap and at its upper end to the well head connector which in turn supports the sensor, the cable and the harness assembly from the well head. The end cap includes a cylindrical bore through which the service cable passes and the bore has an annular groove formed therein. During assembly the end cap is compressed about the service cable by swaging, forcing the service cable jacket to extrude into the groove thereby locking the cable into position in the end cap. In other embodiments of the invention the service cable includes a support cable which is secured within the end cap by a support washer. The support cable is secured at its upper end either by a support washer locked within the well head connector or to a support washer positioned atop the well head.

23 Claims, 6 Drawing Sheets

SERVICE CABLE AND CABLE HARNESS FOR SUBMERSIBLE SENSORS AND PUMPS

BACKGROUND OF THE INVENTION

This invention generally relates to well water monitoring equipment and more particularly to a service cable and cable harness for use with submersible pumps and sensors for monitoring the physical properties of well water.

It is not only desirable but in many circumstances legally required to periodically observe and record the physical characteristics of potable water obtained from wells. The properties of interest typically include pressure, temperature, conductivity and PH level. The absolute value and rate of change of these properties can be quite useful in determining water quality and predicting significant changes in quality. Monitoring is normally accomplished with specialized sensors which are lowered into a well and submerged in the water. Typically the sensors will include one or more sensing devices such as a pressure transducer or temperature sensor for detecting the physical properties of interest. The sensors are normally enclosed in a water tight housing and connected to a multi-conductor cable for transmitting power to and signals from the sensor.

In the monitoring process it may also be desirable to periodically obtain a sample of water from a well. Such samples are typically obtained using a submersible sampling pump which is suspended from the end of a service cable and lowered into the well. Typically these pumps are low profile centrifugal design devices which are electrically or pneumatically powered. The service cables provide power and control inputs to the pumps and include a discharge tube through which well water is transported back to the surface. One such cable is described in applicant's U.S. Pat. No. 5,186,253.

One of the problems which designers of submersible sensors and pumps have faced is how to prevent leakage of well water into the sensor or pump housing. The leakage problem is complicated by the fact that in most sensor and pump designs there are a number of possible leakage paths. Typically, the housings for both types of units have hollow cylindrical bodies and at least one end cap removable for servicing purposes. Accordingly, one such leakage path is at the interface between the cylindrical body and the end cap and another is along the interface between the service cable and the end cap.

The second problem encountered with submersible sensors and pumps is how to support the weight of those devices together with the service cable. If the sensor or pump is relatively light and the well relatively shallow then the service cable itself may be strong enough to support device. If the weight of the submersible unit is sufficiently high, however, the service cable may become dislodged from the harness even though the load is on the cable is well below its tensile strength. Even heavier units will require some load bearing structure in addition to the cable itself for support.

Another problem encountered with the use of submersible sensors and pumps is determining the depth to which the device has been lowered in the well. One solution to the problem has been to place regularly spaced markings or indicators on the service cable from which the depth of the unit can be calculated. A simple approach to the problem is to print such markings on the exterior surface of the cable jacket but it has been found to be difficult to print on curved jacket surfaces and to prevent the markings from being rubbed off during usage. Another approach has been to impress the markings in the jacket by heat stamping and then to fill the impressions with epoxy or another filler to make them more visible. The resulting markings are durable but the process is relatively expensive. Another known method of cable marking involves the application of spaced circular bands containing distance markings to the cable. Again, the resulting markings are relatively durable but the process is costly.

Accordingly, it is an object of this invention to provide for an improved service cable and cable harness for submersible sensors and pumps which will minimize the possibility of leakage into the device.

Another object of this invention is to provide for an improved cable and harness which can support heavier pumps and sensors without the inclusion of reinforcing structure in the cable.

Another object of this invention is to provide for a reinforced cable and harness which can be used with heavier sensors, pumps and extended length cable.

Yet another object of this invention is to provide for a service cable having durable and easily visible markings from which the depth of a sensor or a pump in a well can be computed and an inexpensive method for applying such markings to the cable.

DETAILED DESCRIPTION OF THE PREFERRED EMBODIMENTS

The novel features believed to be characteristic of this invention are set forth in the appended claims. The invention itself however may be best understood and its various objects and advantages best appreciated by reference to the detailed description below in connection with the accompanying drawings.

Figure 1:
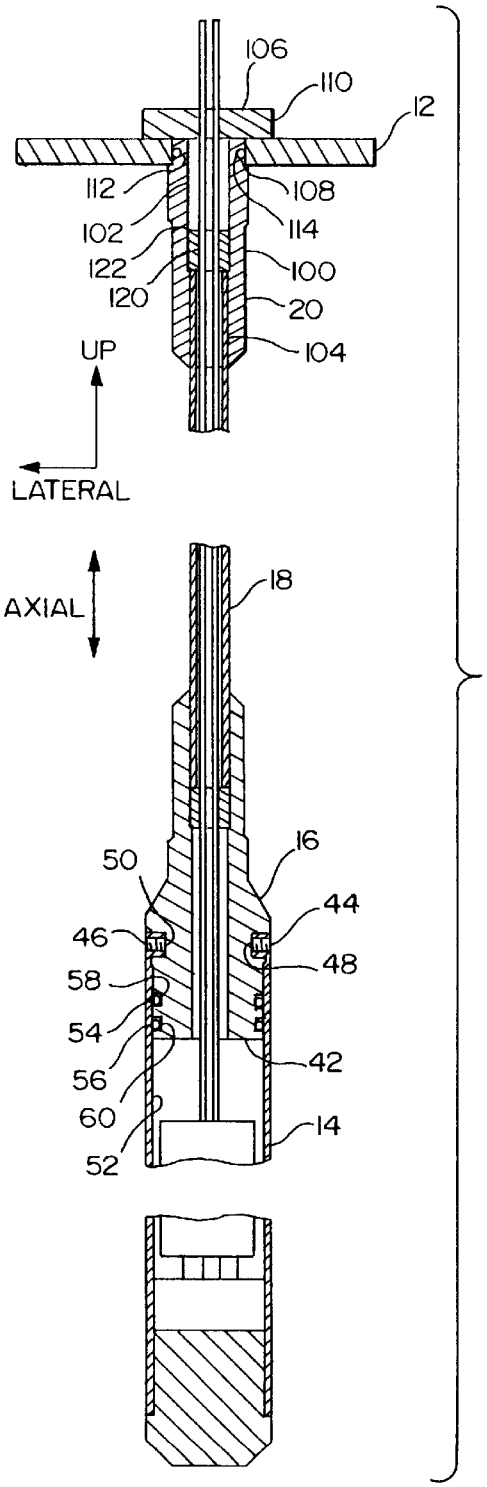
FIG. 1 is a side view partially in section of one embodiment of the subject invention to which a typical submersible sensor is attached.

FIG. 1 illustrates a service cable and cable harness assembly constructed in accordance with the teachings of the present invention and generally designated by the number 10. In this view the assembly is suspended at its upper end from a typical well head 12 (only a portion of which is shown) and is connected at its lower end to a typical submersible sensor 14. The assembly itself includes end cap 16, service cable 18 and well head connector 20.

Figure 3:
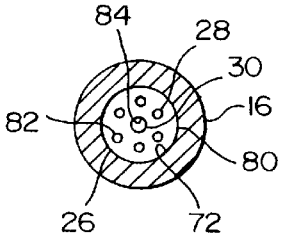
FIG. 3 is a sectional view taken at 3—3 of FIG. 2.
Figure 2:
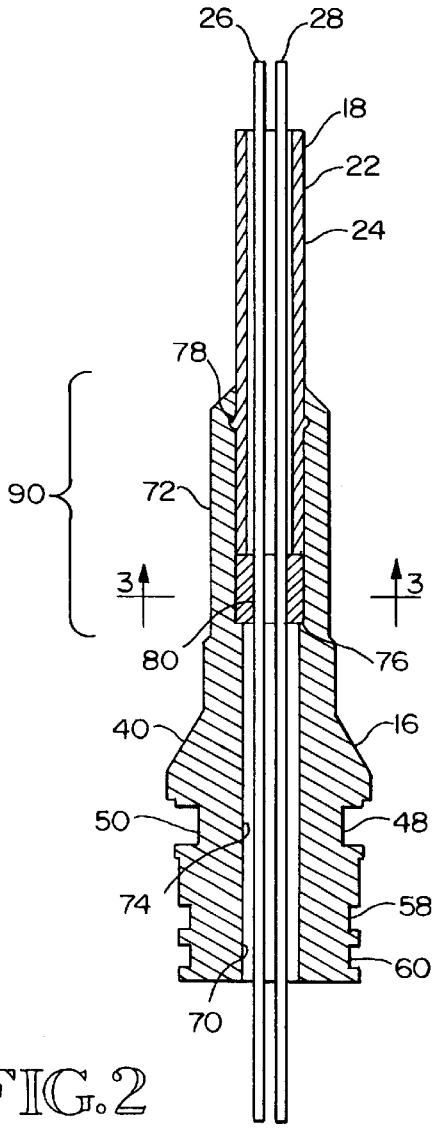
FIG. 2 is a sectional side view of the end cap of the embodiment of FIG. 1.

FIGS. 2 and 3 shown end cap 16 and lower portion 22 of service cable 18 in greater detail. The service cable is a substantially cylindrical multiconductor cable of conventional design which includes an outer jacket 24 preferably made of polyvinyl chloride, Teflon, polyurethane or polyethylene. Radially spaced within jacket 24 are plurality of individually insulated conductors such as conductors 26 and 28. Vent tube 30 which provides the sensor with a source of air at atmospheric pressure is centrally located within the conductor. The vent tube may be eliminated if a sensor not requiring barometric compensation is used.

End cap 16 has a generally cylindrical body 40 the lower portion 42 of which is sized in diameter so as to be slidably insertable in the upper end of sensor 14. The end cap is held in place in the sensor body by set screws 44 and 46 which are threaded through the body into grooves 48 and 50 respectively which are formed in body 40. Leakage between the end cap and inner wall 52 of the sensor is prevented by O-rings 54 and 56 which are seated in circular grooves 58 and 60 respectively formed in body 40. Also formed in body 40 is cylindrical stepped bore 70 through which service cable 18 passes. Bore 70 includes upper section 72 and lower section 74 which is of a slightly lesser diameter than section 72 and which begins at step 76. Cylindrical conductor seal 80, preferably made of Teflon or an elastomer, sealably engages upper portion 72 of bore 70 and is seated against step 76. Referring to FIG. 3 it can be seen that the conductor seal includes a plurality of radially spaced, axially oriented cylindrical passageways such as passageway 82 through which a conductor such as conductor 26 passes. The number of passageways equals the number of conductors in the service cable and each of the passageways sealably engages the conductor which passes through it. Also the conductor seal includes centrally located, axially oriented passageway 84 which sealably engages vent tube 30. An important aspect of this invention is annular groove 78 which is formed near the upper end of bore 72. The significance of this groove will become apparent from the discussion that follows.

In assembling the cable harness jacket 18 is first stripped from lower end 22 of the cable exposing the conductors. The exposed conductors must be of sufficient length that they can be extended as necessary to terminals (not shown) within the sensor when the top plug is attached to the sensor as shown in FIG. 1. Next the conductors and vent tube 30 are inserted through their respective passageways in conductor seal 80 and the seal is slid along the conductors until it abuts the lower end of jacket 18. Then lower end 22 of the service cable with the conductor seal attached is inserted in bore 72 of end cap 16 until the seal rests against step 76 as shown in FIG. 2.

Next, in order to secure the seal and the cable in position portion 90 of the end cap is compressed by swaging. Upon swaging, conductor seal 80 is compressed, causing it to seal tightly against bore 72 and against the conductors and vent tube 30 which pass through it. Also and importantly, cable jacket 18 is compressed, forcing it to extrude into annular groove 78. The resulting assembly is highly resistant to leakage through all possible leakage paths. Leakage along bore 72 is resisted by the seal between conductor seal 80 and the bore, the seal between cable jacket 80 and the bore, and the seal formed by the jacket material which has extruded into groove 78. In other words, the design provides triple redundant protection against leakage along this path. In the event water penetrates the cable jacket above the end cap, that water is prevented from passing through the cable into the sensor by the seals between conductor seal 80, the connectors, and vent tube 80.

Another very significant effect of the extrusion of the cable jacket into groove 78 is to materially increase the resistance of the service cable to being dislodged or pulled out of the end cap. For example, applicant's tests have indicated that the amount of force required to dislodge a typical one-quarter inch diameter service cable is increased by a factor of more than three and that the strength of a harness assembly constructed in accordance with the present invention is essentially determined by the shear strength of the jacket material.

Figure 5:
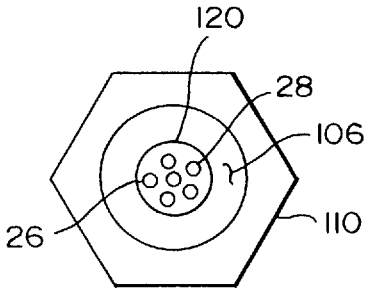
FIG. 5 is a sectional view taken at 5—5 of FIG. 4.
Figure 4:
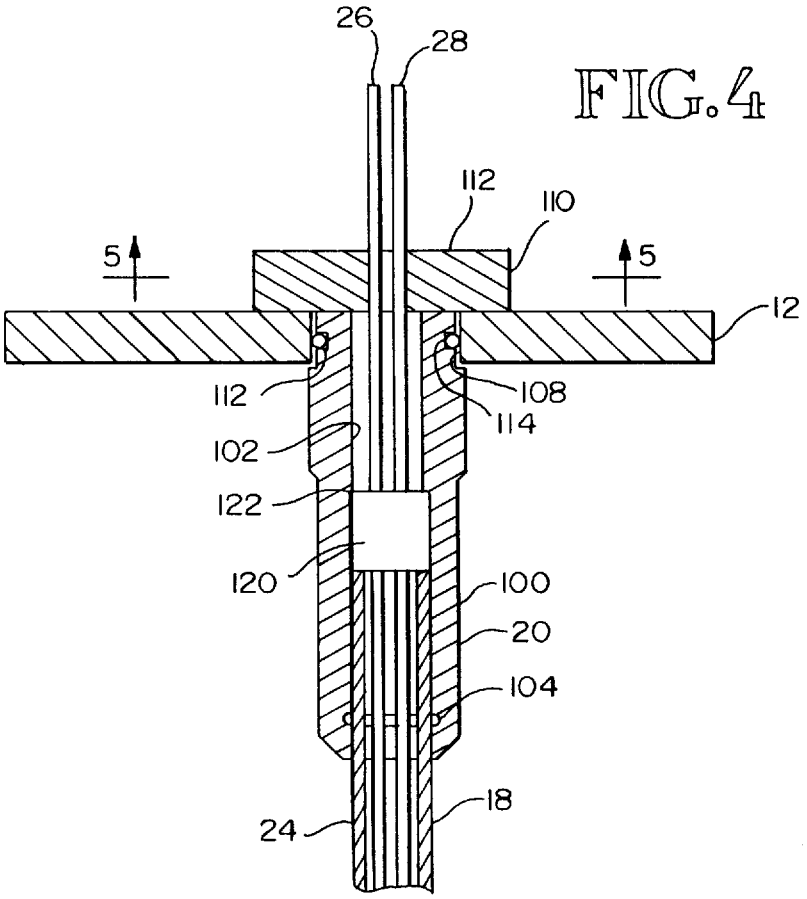
FIG. 4 is a sectional side view of the well head connector of FIG. 1.

FIGS. 4 and 5 illustrate well head connector 20 in greater detail. The construction of lower portion 100 is similar to that of end cap 16 in that it has a generally cylindrical body which includes a stepped bore 102 through which the service cable passes. Annular groove 104 is formed in the bore near the lower end of the connector. Upper end 106 of the connector extends through circular opening 108 in well head 12 and is externally threaded to engage nut 110 which supports the entire weight of the sensor, service cable and harness assembly extending beneath it. Leakage between opening 108 and connector 20 is resisted by O-ring 112 which seats in annular groove 114 formed in the connector and seals against opening 108.

Upper portion of the cable harness is assembled by first stripping the cable jacket then inserting conductor seal 120 (which is identical to conductor seal 80) over the conductors and the vent tube and then positioning it against the end of the cable jacket. Next, the service cable with the conductor seal attached is inserted in the lower end of bore 102 until seal 120 rests against step 122 in the bore. Then, the lower portion of connector 100 is swaged, compressing seal 120 and the service cable against bore 102 and forcing cable jacket 24 to extrude into groove 104.

FIGS. 6 through 11 show second and third embodiments respectively of the subject invention, each intended for use under circumstances where the cable harness would be exposes to loads greater than those which could be supported by the embodiment of FIG. 1. Those loads might result from the weight of the sensor itself, the weight of a lengthy service cable, or a combination of the two. These embodiments differ principally from the embodiment of FIG. 1 in that they include a structural support cable, means for transferring load from the end cap to the lower end of the support cable and means for transferring load from the upper end of the support cable to the well head.

Figure 7:
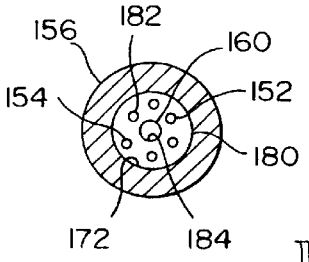
FIG. 7 is a sectional view taken at 7—7 of FIG. 6.
Figure 6:
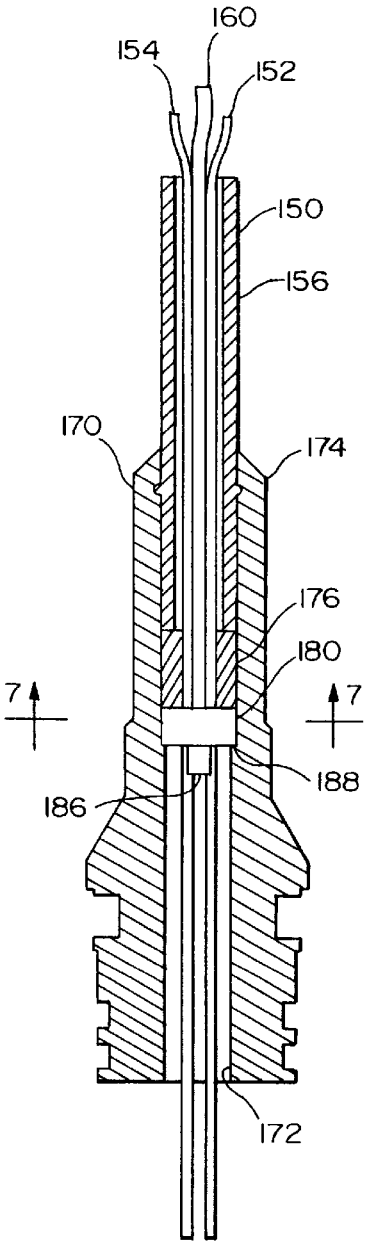
FIGS. 6 is a sectional side view of the end cap of a second embodiment of the present invention.

In the second embodiment, generally designated by the number 148 and illustrated in FIGS. 6 and 7, service cable 150 includes a plurality of conductors such as 152 and 154 which are radially spaced within jacket 156. Also enclosed within the jacket is support cable 160, preferably made of jacketed stainless steel wire rope, which is centrally positioned within the cable and extends axially through it. The harness assembly also includes end cap 170 which is similar in construction to end cap 16. Stepped bore 172 extends axially through the end cap and annular groove 174 is formed in the bore near its upper end. The harness assembly also includes conductor seal 176 which is very similar to conductor seal 80 and cylindrical support washer 180 which is shown in greater detail in FIG. 7. The support washer includes a plurality of radially spaced openings such as opening 182 through which the conductors may be passed and central opening 184 through which support cable 160 will slidably fit.

During assembly of the lower end of the cable harness the jacket is first trimmed away as described above, the conductors and the support cable are passed through conductor seal 176 and the conductor seal is positioned against the end of the jacket. Next, the conductors and the support cable are passed through the respective openings in support washer 180 and the washer is abutted against cable seal 176. Then, stop 186 is swaged in position on the support cable and the cable extending beneath the stop is trimmed. Next, the cable with the conductor seal and support washer in position are inserted in the top of the end cap until the washer rests against step 188 in bore 172. Finally, the end cap is swaged as described above, compressing the cable and the conductor seal and locking support washer 180 in position.

Figure 9:
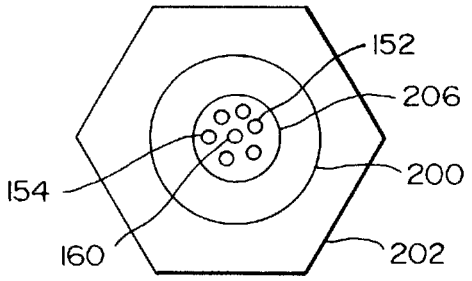
FIG. 9 is a sectional view taken at 9—9 of FIG. 8.
Figure 8:
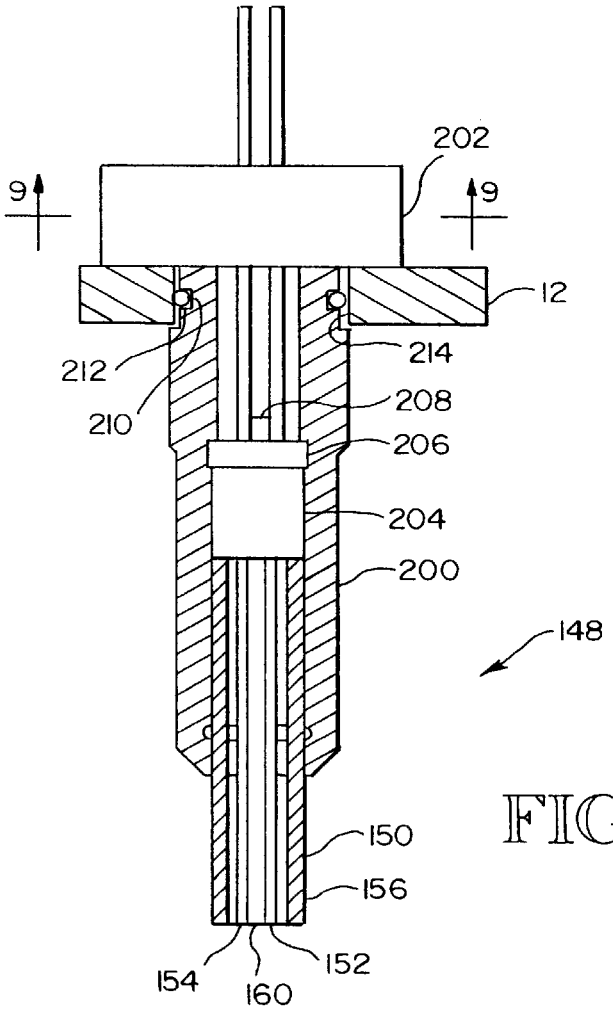
FIG. 8 is a sectional view of the well head connector of a third embodiment of the present invention.

The upper end of the harness assembly of the second embodiment as illustrated in FIGS. 8 and 9 includes well head connector 200 and retaining nut 202 which are very similar in detail to the corresponding components of the first embodiment as illustrated in FIGS. 4 and 5. It includes cable seal 204, support washer 206 and stop 208 which are identical to cable seal 176, support washer 180 and stop 186 respectively. Leakage between well head 12 and well head connector 200 is preventing by O-ring 210 which is seated in annular groove 212 formed in the well head connector and seats against circular opening 214 formed in the well head. As can be seen the weight of the sensor is transferred through end cap 170 and support washer 180 to support cable 160. It is also partially transferred through the end cap to cable jacket 156. At the upper end of the harness assembly, load is transferred from the support cable and the cable jacket through well head connector 200 and retaining nut 202 to well head 12.

Figure 11:
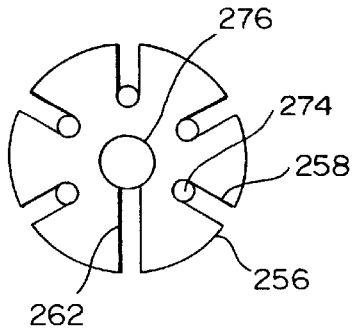
FIG. 11 is a sectional view taken at 11—11 of FIG. 10.
Figure 10:
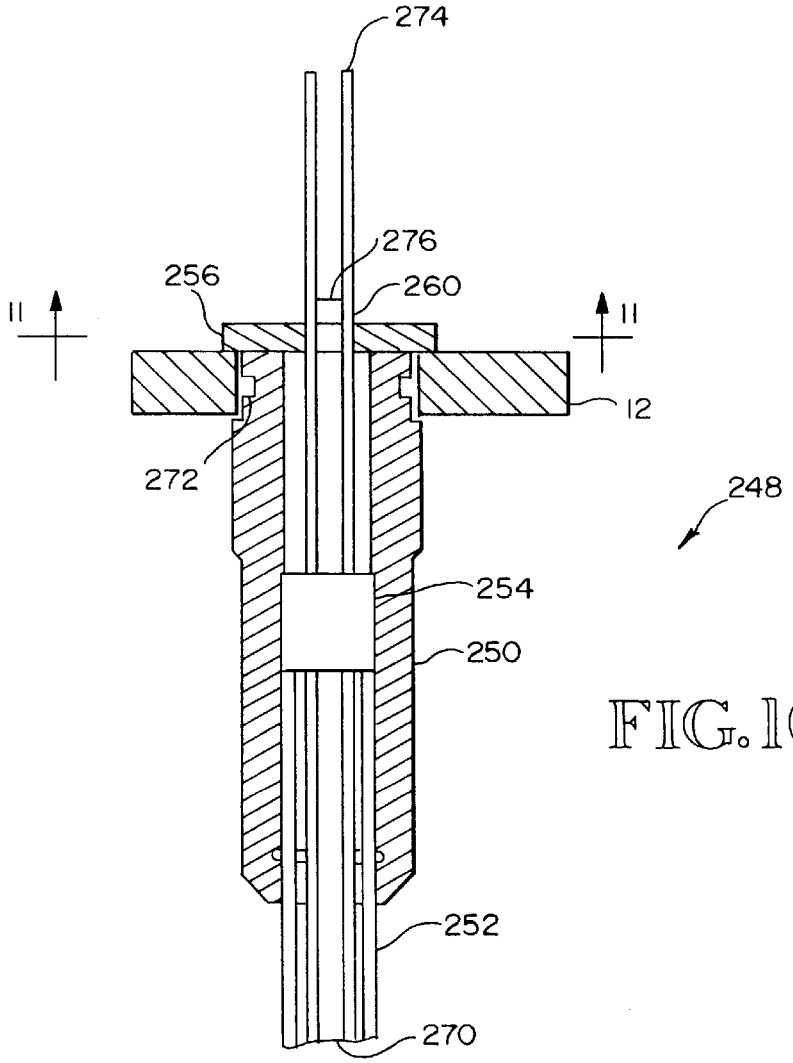
FIG. 10 is a sectional view of the well head connector of a third embodiment of the present invention.

The third embodiment of this invention, generally designated by the number 248, also includes a support cable centrally disposes within the service cable but differs from the second embodiment in the means employed to transfer load from the service cable to the well head. Referring to FIGS. 10 and 11 which illustrates the upper portion of the harness assembly of the third embodiment, it can be seen that the harness assembly includes well head connector 250, service cable 252 and conductor seal 254 which are substantially identical to well head connector 200, service cable 150 and conductor seal 204 respectively. Further, this embodiment includes support washer 256 which has a plurality of radially extending slots of which slot 258 is typical, a centrally located opening 260 and a somewhat larger slot 262 extending from that central opening to the edge of the disk. When the upper portion of the harness is assembled the service cable and the conductor seal are positioned in well head connector 250 as shown and support cable 270 is trimmed to extend somewhat above the upper end of connector 250. Next, connector 250 is inserted through opening 272 in well head 12 and held in position while conductors such as conductor 274 are positioned in appropriate radially extending slots such as slot 258 and support cable 270 is passed through slot 262 into central opening 260. Finally, stop 276 is swaged on the support cable.

Figure 12:
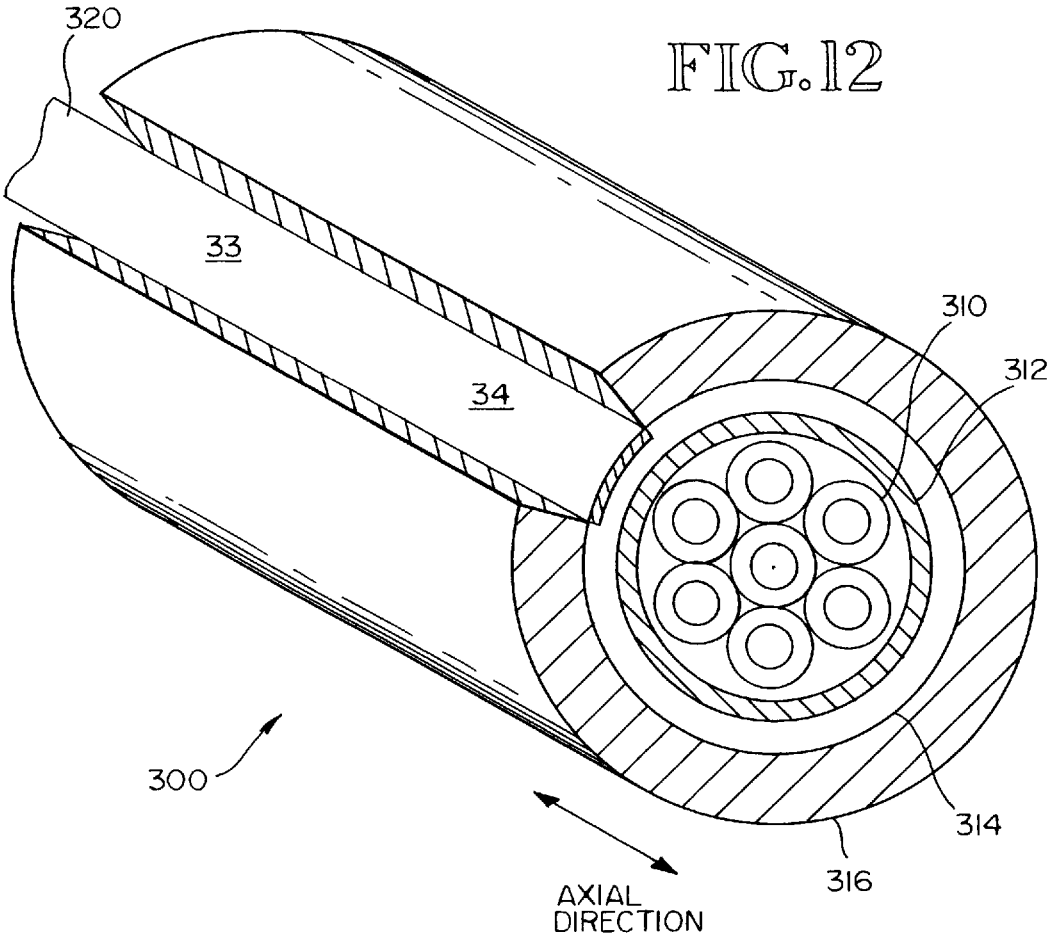
FIG. 12 is a perspective view of a segment of the service cable in a fourth embodiment of the subject invention.

FIG. 12 illustrates a fourth embodiment of the present invention, generally designated by the number 300, in which the service cable includes a distance measuring tape. The cable is substantially circular in cross section and includes a plurality of insulated conductors such as conductor 310 which are encased within a cylindrical shield 312 preferably made of braided copper. To protect the conductors from abrasion a wrap of clear Mylar (not shown) may be positioned between the conductor bundle and the shield. Surrounding this shield is a cylindrical Mylar layer 314, and these elements, collectively referred to herein as the cable core, are enclosed within cable jacket 316. The particular core construction described herein is merely an example and is not material to this embodiment of the invention. For the purposes of this embodiment, the core may be composed of other elements. The jacket should be made from a thermoplastic material which is transparent, resistant to abrasion and impervious to water. Preferably it is formed form clear polyurethane, PVC or Teflon. Positioned between jacket 316 and Mylar casing 314 is tape 320 to which spaced distance markings or indicators such as the numbers "33" and "34" have been applied. The tape should be made of a material which exhibits relatively high strength, low yield under load and resistance to temperatures in the range of the melting point of the jacket material. Further, it should be a material which can be printed upon. Applicant has found that a material sold under the trademark "Kapton" is suitable for the subject measuring tape.

Thus is can be seen that the present invention provides for an improved service cable and cable harness for submersible sensors and pumps which incorporates many novel features and offers significant advantages over the prior art. Although only four embodiments of this invention have been illustrated and described it is to be understood that obvious modifications can be made of them without departing from the true scope and spirit of the invention.

I claim:

1. A cable harness assembly comprising:

a housing having a bore extending therethrough, the bore having a circumferential recess formed therein; and, a service cable extending at least partially through the bore and including at least one electrical conductor, the service cable including an extrudable jacket having opposing ends, the jacket extending into the recess intermediate the ends.

2. The cable harness assembly of claim 1 further including a conductor seal sealably engaging the conductor and the bore.

3. A cable harness assembly comprising:

a well head connector having a bore extending therethrough, the bore having a circumferential recess therein; and, a service cable extending at least partially through the bore, the service cable including an extrudable jacket having opposing ends, the jacket extending into the recess intermediate the ends.

4. The cable harness assembly of claim 3 further including means for attaching the well head connector to a well head.

5. The cable harness assembly of claim 4 wherein the means for attaching includes a nut threadably engageable with the well head connector.

6. The cable harness assembly of claim 3 further including a conductor seal sealably engaging the conductor and the bore.

7. A cable harness assembly comprising:

a housing having a first bore extending therethrough, the first bore having a first circumferential recess formed therein;

a well head connector having a second bore extending therethrough, the second bore having a second circumferential recess therein; and, a service cable including at least one electrical conductor extending at least partially through the first and second bores, the service cable having an extrudable jacket extending into the first and second recesses.

8. A cable harness assembly comprising:

a housing having a bore extending therethrough;

a service cable extending at least partially through the bore and including at least one electrical conductor and a support cable; and, means for connecting the housing to the support cable.

9. The cable harness assembly of claim 8 wherein the means for connecting includes a support washer secured within the bore and connected to the support cable.

10. The cable harness assembly of claim 8 wherein the bore has a circumferential recess found therein and the service cable has an extrudable jacket extending into the recess.

11. The cable harness assembly of claim 8 further including a conductor seal sealably engaging the electrical conductor, the support cable and the bore.

12. A cable harness assembly comprising:

a well head connector having a bore extending therethrough;

a service cable extending at least partially through the bore and including at least one electrical conductor and a support cable; and, means for connecting the service cable to the well head connector.

13. The cable harness assembly of claim 12 wherein the means for connecting includes a support washer secured within the bore and connected to the support cable.

14. The cable harness assembly of claim 12 further including a conductor seal sealably engaging the electrical conductor, the support cable and the bore.

15. The cable harness assembly of claim 12 wherein the bore has a circumferential recess formed therein and the service cable has an extrudable jacket extending into the recess.

16. The cable harness assembly of claim 12 further including means for attaching the well head connector to a well head.

17. The cable harness assembly of claim 16 wherein the means for attaching is a nut threadably engageable with the well head connector.

18. A cable harness assembly comprising:

a housing having a first bore extending therethrough;

a well head connector having a second bore extending therethrough;

first and second support washers secured in the first and second bores, respectively; and, a service cable extending at least partially through each bore and including at least one electrical conductor and a support cable, the support cable being attached to each support washer.

19. A cable harness assembly comprising:

a well head connector having a bore extending therethrough;

a service cable extending at least partially through the bore and including at least one electrical conductor and a support cable; and, means for connecting the service cable to a well head.

20. The cable harness assembly of claim 19 wherein the means for connecting includes a support washer connected to the support cable.

21. The cable harness assembly of claim 19 further including a conductor seal sealably engaging the electrical conductor, the support cable and the bore.

22. The cable harness assembly of claim 19 wherein the bore has a circumferential recess formed therein and the service cable has an extrudable jacket extending into the recess.

23. The cable harness assembly of claim 20 wherein the support washer includes at least one radially extending slot.

* * * * *